US009206705B2

(12) United States Patent
Hashimoto et al.

(10) Patent No.: US 9,206,705 B2
(45) Date of Patent: Dec. 8, 2015

(54) SEALING DEVICE AND GAS TURBINE HAVING THE SAME

(71) Applicant: MITSUBISHI HEAVY INDUSTRIES, LTD., Tokyo (JP)

(72) Inventors: Shinya Hashimoto, Tokyo (JP); Norikazu Tezuka, Tokyo (JP); Kazuharu Hirokawa, Tokyo (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 400 days.

(21) Appl. No.: 13/669,947

(22) Filed: Nov. 6, 2012

(65) Prior Publication Data

US 2013/0236305 A1 Sep. 12, 2013

(30) Foreign Application Priority Data

Mar. 7, 2012 (JP) ..... 2012-050430

(51) Int. Cl.
*F01D 25/24* (2006.01)
*F01D 11/00* (2006.01)
*F01D 25/30* (2006.01)

(52) U.S. Cl.
CPC ..... *F01D 25/24* (2013.01); *F01D 11/003* (2013.01); *F01D 25/30* (2013.01)

(58) Field of Classification Search
CPC ..... F01D 25/24; F01D 25/30; F01D 11/003; F01D 11/005
USPC ..... 415/134; 277/644
See application file for complete search history.

(56) References Cited

U.S. PATENT DOCUMENTS 3,303,997 A 2/1967 Welch
5,104,286 A 4/1992 Donlan (Continued)

FOREIGN PATENT DOCUMENTS

CN 101372904 A 2/2009
CN 101960101 A 1/2011

(Continued)

OTHER PUBLICATIONS

International Search Report of PCT/JP2012/078829, mailing date of Dec. 11, 2012, w/English translation.

(Continued)

*Primary Examiner* — Troy Chambers
*Assistant Examiner* — Joshua Semick
(74) *Attorney, Agent, or Firm* — Westerman, Hattori, Daniels & Adrian, LLP

(57) ABSTRACT

In a sealing device which seals between an outside space between an outer side in the radial direction of an external diffuser which has a tubular shape and forms an exhaust channel through which combustion gas rotating a rotor of a gas turbine passes in the inner side in the radial direction and an outside member which is disposed outside the external diffuser with an interval between them in the radial direction, and the exhaust channel by an end of the external diffuser, a first seal plate group and a second seal plate group in which a plurality of seal plates, which extend to the outer side in the radial direction from the end of the tubular external diffuser and reach the outside member, are laminated in contact with each other, and a spacer which maintains the first seal plate group and the second seal plate group with an interval in an axial direction in which a rotational axis of the rotor extends are provided.

8 Claims, 8 Drawing Sheets

(56) References Cited

U.S. PATENT DOCUMENTS

| | | | |
|---|---|---|---|
| 6,065,756 | A | 5/2000 | Eignor et al. |
| 6,315,301 | B1 | 11/2001 | Umemura et al. |
| 2006/0197287 | A1 | 9/2006 | Farah et al. |
| 2011/0005234 | A1 | 1/2011 | Hashimoto et al. |

FOREIGN PATENT DOCUMENTS

| | | | |
|---|---|---|---|
| EP | 1 046 788 | B1 | 8/2004 |
| EP | 2 385 221 | A1 | 11/2011 |
| GB | 1344305 | A | 1/1974 |
| JP | 52-070212 | A | 6/1977 |
| JP | 1-85429 | A | 6/1989 |
| JP | 05-052122 | A | 3/1993 |
| JP | 11-247999 | A | 9/1999 |
| JP | 2002-536595 | A | 10/2002 |
| JP | 2006-242177 | A | 9/2006 |
| JP | 2009-052552 | A | 3/2009 |
| JP | 2009-203871 | A | 9/2009 |

OTHER PUBLICATIONS

Written Opinion of PCT/JP2012/078829, mailing date of Dec. 11, 2012.

Office Action dated Apr. 1, 2015, issued in corresponding Chinese Patent Application No. 201280071090.2, with English translation (10 pages).

Office Action dated Jun. 9, 2015, issued in counterpart Japanese Patent Application No. 2014-503415, with English translation (5 pages).

INITIAL STAGE AFTER DEFORMATION

INITIAL STAGE AFTER DEFORMATION

SEALING DEVICE AND GAS TURBINE HAVING THE SAME

TECHNICAL FIELD

The present invention relates to a sealing device which seals an end of a diffuser of a gas turbine, and a gas turbine having the sealing device.

The present application claims priority on Japanese Patent Application No. 2012-050430, filed Mar. 7, 2012, the content of which is incorporated herein by reference.

BACKGROUND ART

A gas turbine includes a compressor which compresses outside air and generates compressed air, a combustor which mixes fuel with the compressed air, combusts the mixture, and generates combustion gas, and a turbine which has a rotor rotated by the combustion gas. The rotor includes a rotor main body which extends in an axial direction parallel to a rotational axis with the rotational axis as the center, and a plurality of blade stages which are fixed to the outer circumference of the rotor main body and are aligned in the axial direction. The combustion gas passing through the final blade stage is discharged to the atmosphere through the inside of the exhaust casing, the inside of the exhaust chamber, and the inside of the exhaust duct as exhaust gas.

In a gas turbine disclosed in Patent Document 1 below, the exhaust casing is formed by a cylindrical exhaust casing wall with the rotational axis of the rotor as the center. The exhaust chamber is formed by an exhaust chamber support which is connected on the downstream side of the exhaust casing wall and an exhaust chamber wall. A cylindrical external diffuser and a cylindrical internal diffuser are provided on the inner side in the radial direction of the exhaust casing wall and the exhaust chamber support with the rotational axis of the rotor as the center. The internal diffuser is disposed inside the external diffuser with an internal therebetween in the radial direction. An exhaust channel of the combustion gas is formed between the external diffuser and the internal diffuser.

A sealing device is provided on the downstream end of the exhaust casing wall and the upstream end of the exhaust chamber support. The sealing device which is provided on the downstream of the exhaust casing wall is a device which seals between the exhaust channel and the outside space between the exhaust casing wall and the external diffuser disposed in the inner side in the radial direction of the exhaust casing wall. The sealing device which is provided on the exhaust channel end of the exhaust chamber support is a device which seals between the exhaust channel and the outside space between the exhaust chamber support and the external diffuser disposed in the inner side in the radial direction of the exhaust chamber support.

Each sealing device includes two seal plates which are disposed with an interval therebetween in the axial direction and a spacer which maintains the mutual interval in the axial direction between the two seal plates.

PRIOR ART DOCUMENT

Patent Document

[Patent Document 1] Japanese Unexamined Patent Application, First Publication No. 2009-203871

DISCLOSURE OF THE INVENTION

Problem that the Invention is to Solve

Two seal plates of the sealing device disclosed in Patent Document 1 are formed of a thin metal plate which is easily deformed in order to permit thermal expansion differences between the exhaust casing wall or the exhaust chamber support and the external diffuser. Thereby, the seal plate is easily vibrated due to gas which exists on the inside in the radial direction and on the outside in the radial direction of the external diffuser respectively, and there is a concern that the sealing device may be damaged in a relatively short time.

The present invention provides sealing device capable of suppressing damage and a gas turbine having the sealing device.

Means to Solve Problem

According to a first aspect of the present invention there is provided a sealing device which seals between an outside space between an outer side in the radial direction of an external diffuser which has a tubular shape and forms an exhaust channel through which combustion gas rotating a rotor of a gas turbine passes in the inner side in the radial direction and an outside member which is disposed outside the external diffuser with an interval therebetween in the radial direction, and the exhaust channel by an end of the external diffuser including: a first seal plate group and a second seal plate group in which a plurality of seal plates, which extend to the outer side in the radial direction from the end of the tubular external diffuser and reach the outside member, are laminated in contact with each other; and a spacer which maintains the first seal plate group and the second seal plate group with an interval in an axial direction in which a rotational axis of the rotor extends.

Since the sealing device partitions the outside space and the exhaust channel side by the first and second seal plate groups, sealing between the outside space and the exhaust channel side can be perforated.

In the sealing device, even when the seal plate which contacts the combustion gas among the plurality of seal plates of the exhaust channel side seal plate group receives vibration energy from the combustion gas, due to friction with another seal plate which contacts the seal plate, which contacts the combustion gas, on the surface facing the axial direction, the vibration energy is absorbed, and the vibration of the plurality of seal plates can be decreased. Similarly, even when the seal plate which contacts air among the plurality of seal plates of the outside space side seal plate group receives vibration energy from the air, due to friction with another seal plate which contacts the seal plate, which contacts the air, on the surface facing the axial direction, the vibration energy is absorbed and the vibration of the plurality of seal plates can be decreased.

Thereby, in the sealing device, the vibration of each seal plate group can be decreased, and damage to the plurality of seal plates due to the vibration can be suppressed.

In the sealing device according to a second aspect of the present invention, the plurality of seal plates which configure the first seal plate group or the second seal plate group may be configured so as to have a plurality of divided pieces which are aligned in a circumferential direction around the rotor and forms a portion in the circumferential direction, and a position of a parting line in the circumferential direction in the plurality of divided pieces which configure the first seal plate group or the second seal plate group, and position of a parting line in the circumferential direction in other divided pieces which contact the divided pieces, which configure the first wall plate group or the second seal plate group, on the surface facing the axial direction, may be different from each other in the circumferential direction.

Since all of each seal plates which configure the seal plate groups of the sealing device are divided in the circumferential direction, gas is leaked from the parting line of the divided pieces which are aligned in the circumferential direction. However, in the sealing device, the position of the parting line in the circumferential direction in the plurality of divided pieces which configure one sheet plate of the plurality of seal plates which configure the seal plate groups and the position of a parting line in the circumferential direction in the other divided pieces which contact the divided pieces which configure the seal plate on the surface facing the axial direction are different from each other in the circumferential direction. Thereby, in the sealing device, even when gas is leaked from the parting line in the circumferential direction in the plurality of divided pieces which configure the seal plate, the leakage of the gas from the parting line in the circumferential direction can be prevented due to another seal plate which contacts the seal plate on the surface facing the axial direction.

In the sealing device according to a third aspect of the present invention, the spacer may include an outside spacer which maintains an interval between the outer side portion in the radial direction of the second seal plate group and an outer side portion in the radial direction of the second seal plate group, and an inside spacer which maintains an interval between an inner side portion in the radial direction of the first seal plate group and an inner side portion in the radial direction of the second seal plat group.

In the sealing device, since stiffness in the radial direction can be increased, buckling strength in the radial direction can be increased.

In the sealing device according to a fourth aspect of the present invention, a seal air hole which penetrates from the outer side in the radial direction toward the inner side in the radial direction may be formed in the outside spacer.

In the sealing device, since seal air is supplied between the first seal plate group and the second seal plate group, sealability between the outside space and the exhaust channel side can be increased.

In the sealing device which includes the outside spacer according to a fifth aspect of the present invention, the sealing device may include an intermediate spacer which maintains an interval of the first seal plate group and the second seal plate group between the outside spacer and the inside spacer.

In the sealing device, since the supporting point spans of the inst seat plate group and the second seal plate group in the radial direction are decreased, stiffness and buckling strength in the radial direction can be further improved. In the sealing device, since the supporting point spans of the first seal plate group and the second seal plate group in the radial direction are decreased, vibration amplitudes of the first seal plate group and the second seal plate group can be decreased, and damage of the seal plate due to the vibration can be suppressed.

In the sealing device which includes the intermediate spacer according to a sixth aspect of the present invention, the sealing device may include a connector which penetrates the first seal plate group, the intermediate spacer, and the second seal plate group and makes the first seal plate group and the second seal plate group come into close contact with the intermediate spacer, and a combustion gas side through hole, which is formed in the second seal plate group and which the connector penetrates, may be formed so as to be larger than the outer diameter of the connector so that the second seal plate group can move relative to the connector in the radial direction.

In the sealing device, even when a thermal expansion difference is generated between the first seal plate group and the second seal plate group, since the second seal plate group can move relative to the connector in the radial direction, it is possible to prevent the connector from being inclined. In the seal plate groups, if the connector is inclined, there are concerns that not only the seal plate group may be locally deformed in the vicinity of the connector but also the seal plate group may contact the outer edge of the connector and be damaged.

However, in the sealing device, since the inclination of the connector can be prevented damage of each seal plate group can be prevented.

In the sealing device which includes the intermediate spacer according to a seventh aspect of the present invention, a thickness in the axial direction of the second seal plate group may be smaller than an interval in the axial direction which is formed between the intermediate spacer and a nut side washer of the connector.

In the sealing device, since the interval is formed between the intermediate spacer and the nut side washer of the connector in the axial direction of the seal plate of the second seal plate group, the relative movement in the radial direction of the seal plate can be smoother.

In the sealing device according to an eighth aspect of the present invention, the sealing device may include an outside mounting tool which sandwiches the outer side portion in the radial direction of the first seal plate group, the outside spacer, and the outer side portion in the radial direction of the second seal plate group between the outer side portions of the first and second seal plate groups and the outside spacer to the outside member, and an inside mounting tool which sandwiches the inner side portion in the radial direction of the first seal plate group, the inside spacer, and the inner side portion in the radial direction of the second seal plate group between the external diffuser and the inside mounting tool in the axial direction and mounts the inner side portions of the first and second seal plate groups and the inside spacer to the external diffuser, and any one mounting tool of the inside mounting tool and the outside mounting tool may mount the first seal plate group and the second seal plate group so as to be able to move relative to an object to be mounted in the radial direction.

Since the external diffuser contacts the combustion gas during operation of the gas turbine expansion difference is generated between the outside member and the external diffuser, and thus, the diameter of the external diffuser is relatively changed with respect to the diameter of the outside member. In the sealing device, since one mounting tool can mount one seal plate group and the other seal plate group so as to be able to move relative to an object to be mounted in the radial direction, the relative change of the diameter of the external diffuser with respect to the diameter of the outside member can be permitted due to the relative movement.

According to a ninth aspect of the present invention, there is provided a gas turbine including the sealing device, the external diffuser, and the outside member.

Since the gas turbine also includes the sealing device, sealing can be performed between the outside space and the exhaust channel side, vibration of each seal plate group can be decreased, and damage of the seal plate due to the vibration can be suppressed.

In the gas turbine according to a tenth aspect of the present invention, a seal air channel for supplying seal air between the first seal plate group and the second seal plate group may be formed in the outside member.

In the gas turbine, since the seal air is supplied between the first seal plate group and the second seal plate group, sealability between the outside space and the exhaust channel side can be increased.

Effects of the Invention

In the present invention, since an outside space and an exhaust channel side are partitioned by a first and second seal plate groups, sealing between the outside space and the exhaust channel side can be performed. In the present invention, since the vibration of each seal plate group can be decreased, damage of the seal plate due to vibration can be suppressed.

EMBODIMENTS OF THE INVENTION

Hereinafter, an embodiment of a gas turbine according to the present invention will be described in detail with reference to FIGS. 1 to 8.

Figure 1:
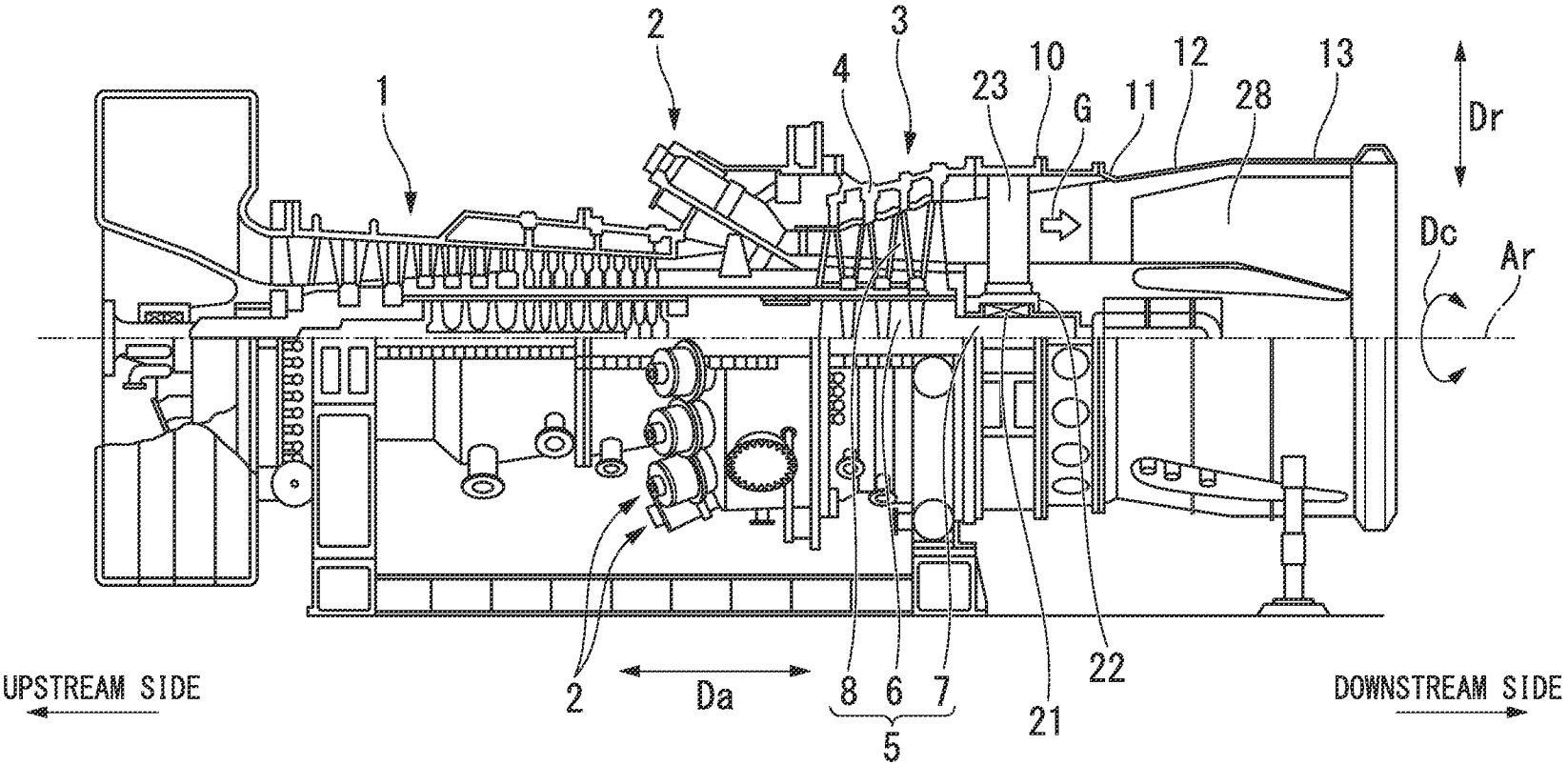
FIG. 1 is cutoff side view of a main portion of a gas turbine in an embodiment according to the present invention.

As shown in FIG. 1, a gas turbine of the present embodiment includes a compressor 1 winch compresses the outside air and generates compressed air, a plurality of combustors 2 which mix fuel from a fuel supply source with the compressed air, combust the mixture, and generate combustion gas, and a turbine 3 which is driven by the combustion gas.

The turbine 3 includes a casing 4 and a turbine rotor 5 which is rotated in the casing 4. For example, the turbine rotor 5 is connected to a generator (not shown) which generates electricity by the rotation of the turbine rotor 5. The plurality of combustors 2 are fixed to the casing 4 at equal intervals to one another in a circumferential direction Dc with a rotational axis Ar of the turbine rotor 5 as the center. Moreover, hereinafter, the direction in which the rotational axis Ar extends is referred to a an axial direction Da, and the radial direction with respect to the rotational axis Ar is simply referred to as a radial direction Dr. In the axial direction Da, the compressor 1 side based on the turbine 3 is referred to as an upstream side, and the turbine 3 side based on the compressor 1 is referred to as a downstream side.

The turbine rotor 5 includes a rotor disk 6 which has the rotational axis Ar as the center at each of a plurality of stages which are aligned in the axial direction Da, a plurality of blades 8 which are aligned in the circumferential direction Dc and are fixed to the rotor disk 6, and a shaft portion 7 which is fixed to the rotor disk 6 of the final stage and extends in the axial direction Da. The shaft portion 7 is formed in a columnar shape with the rotational axis Ar as the center and is provided in the downstream side of the rotor disk 6 of the final stage.

The casing 4 is formed in a cylindrical shape with the rotational axis Ar as the center, and includes an exhaust casing wall 10 which is deposed further downstream than the blade 8 of the final stage, an exhaust chamber support 11 which is disposed in the downstream side of the exhaust casing wall 10, an exhaust chamber wall 12 which is disposed in the downstream side of the exhaust chamber support 11, and an exhaust duct 13 which is disposed in the downstream side of the exhaust chamber wall 12.

Figure 2:
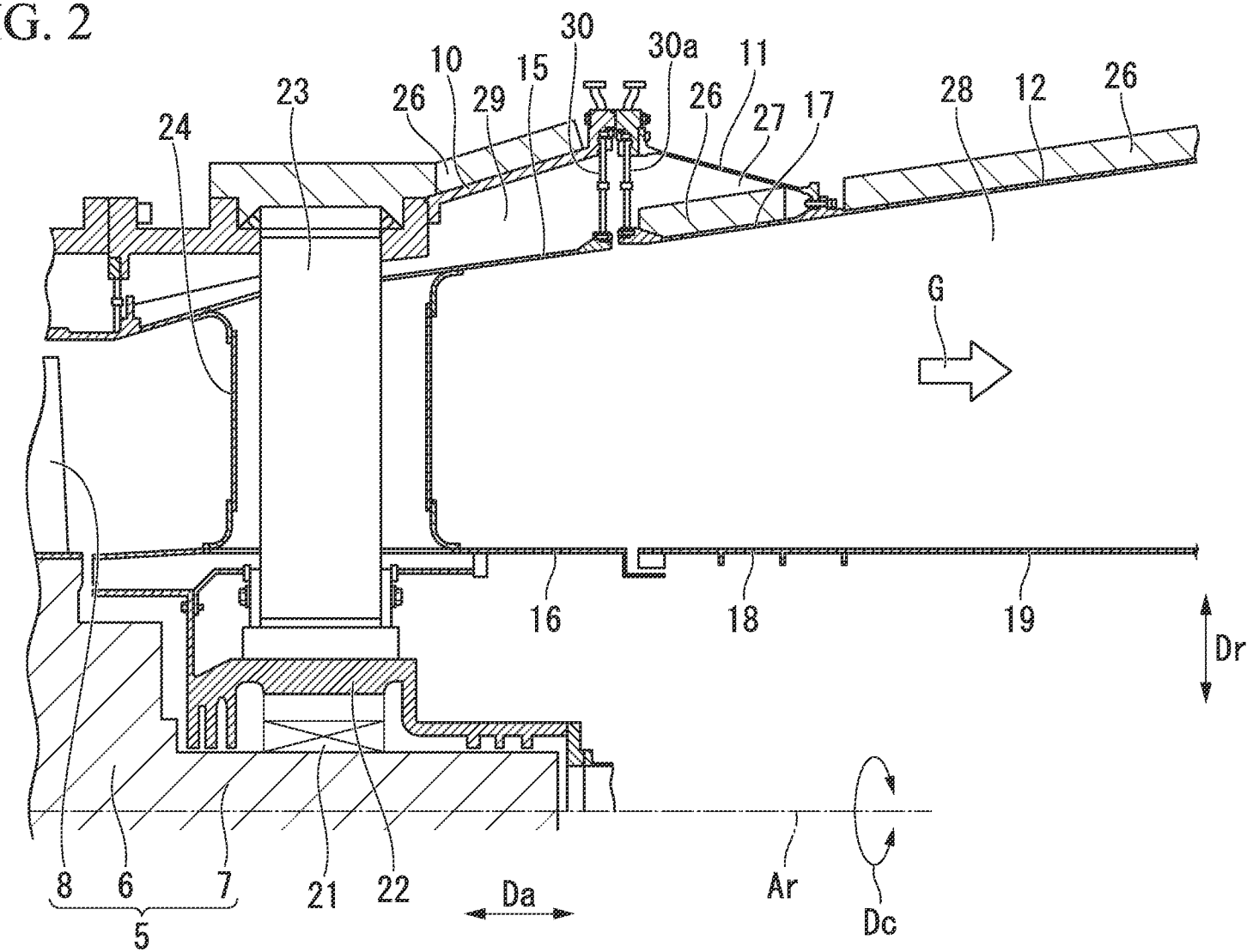
FIG. 2 is a cross-sectional view of the main portion of the gas turbine in the embodiment according to the present invention.

As shown in FIG. 2, a cylindrical external diffuser 15 and a cylindrical internal diffuser 16 are disposed with the rotational axis Ar as the center in the inner side in the radial direction of the exhaust casing wall (outside member) 10. The external diffuser 15 is provided along the inner circumferential surface of the exhaust casing wall 10. The internal diffuser 16 is disposed inside the external diffuser 15 with an interval between them in the radial direction.

A bearing 21 which rotatably supports the shaft portion 7 of the turbine rotor 5 and a bearing box 22 which covers the outer circumferential side of the bearing 21 and supports the bearing 21 are provided in the inner side in the radial direction of the internal diffuser 16. The exhaust casing wall 10 and the bearing box 22 are connected to each other by a strut 23 which penetrates the external diffuser 15 and the internal diffuser 16. The strut 23 is covered by a strut cover 24 along the extension direction of the strut 23. One end in the extension direction of the strut cover 24 is mounted to the external diffuser 15 and the other end is mounted to the internal diffuser 16.

Similar to the inner side in the radial direction of the exhaust casing wall 10, a cylindrical external diffuser 17 and a cylindrical internal diffuser 18 are disposed with the rotational axis Ar as the centers in the inner side in the radial direction of the exhaust chamber support (outside member) 11. The external diffuser 17 is provided along the inner circumferential surface of the exhaust chamber support 11. The internal diffuser 18 is disposed in the inner side in the radial direction of the external diffuser 17 with an interval between them. The exhaust chamber wall 12 functions as the external diffuser. A cylindrical internal diffuser 19 is disposed with the rotational axis Ar as the center in the inner side in the radial direction of the exhaust chamber wall 12.

A space between the external diffuser 15 and the internal diffuser 16 which are disposed in the inner side in the radial direction of the exhaust casing wall 10, a space between the external diffuser 17 and the internal diffuser 18 which are disposed in the inner side in the radial direction of the exhaust chamber support 11, a space between the exhaust chamber wall 12 which functions as the external diffuser and the internal diffuser 19 of the exhaust chamber wall, and a space of the inner side in the radial direction of the exhaust duct 13 (FIG. 1) form an exhaust channel 28 of combustion gas G which rotates the turbine rotor 5.

Heat insulators 26 are provided on the surface of the outer side in the radial direction of the exhaust casing wall 10, the surface of the outer side in the radial direction of the external diffuser 17 positioned in the inner side in the radial direction of the exhaust chamber support 11, and the surface of the outer side in the radial direction of the exhaust chamber wall 12.

Figure 3:
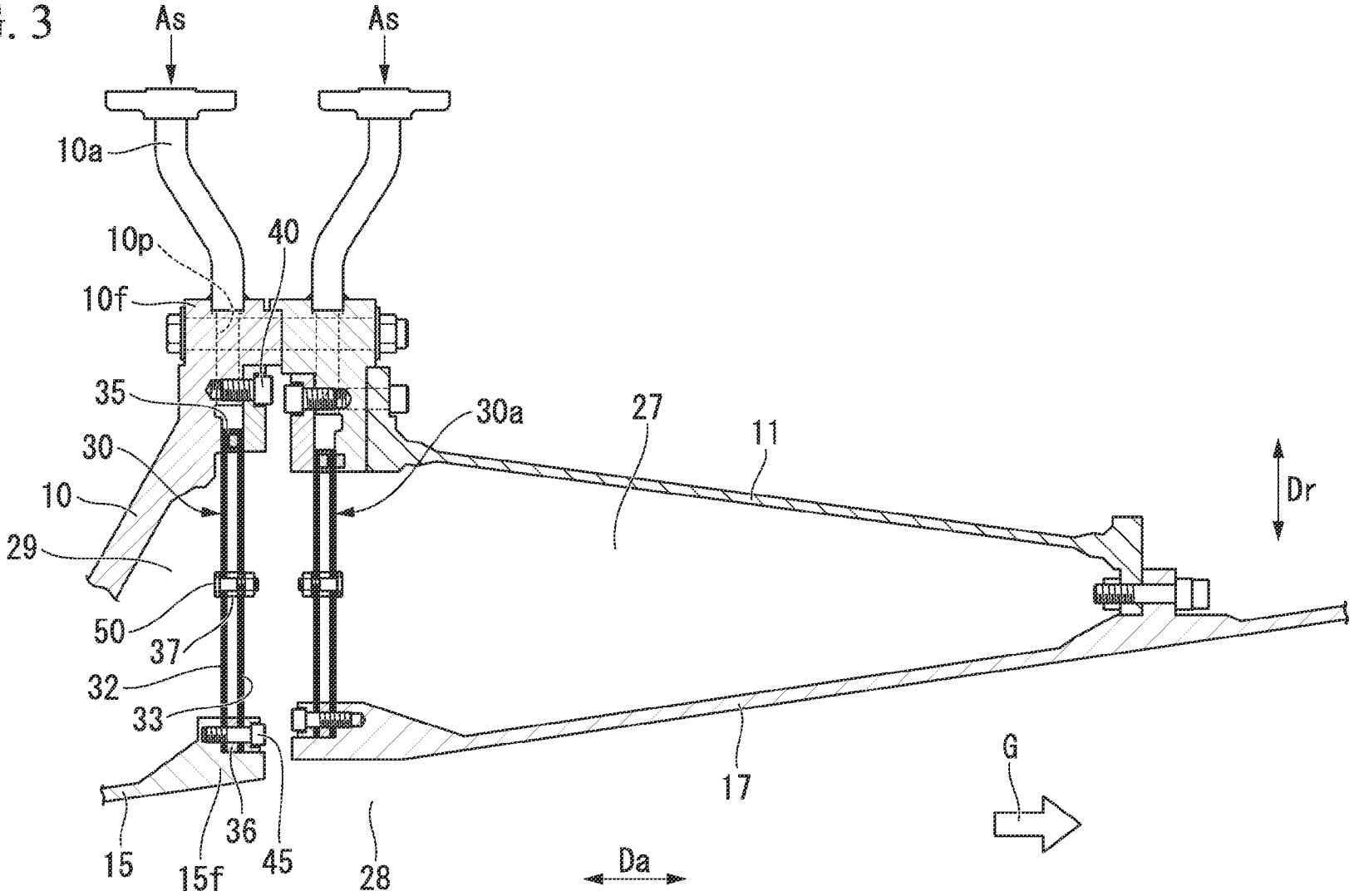
FIG. 3 is a cross-sectional view of the gas turbine around a sealing device in the embodiment according to the present invention.

As shown in FIG. 3, sealing devices 30 and 30*a* are provided on the downstream end of the exhaust casing wall 10 and the upstream end of the exhaust chamber support 11 respectively. The sealing device 30 which is provided on the downstream end of the exhaust casing wall 10 is a device which seals between an outside space 29 between the exhaust casing wall 10 and the external diffuser 15 which is disposed in the inner side in the radial direction of the exhaust casing wall 10, and the exhaust channel 28. The sealing device 30*a* which is provided on the upstream end of the exhaust chamber support 11 is a device which seals between an outside space 27 between the exhaust chamber support 11 and the external diffuser 17 which is disposed on the inner side in the radial direction of the exhaust chamber support 11, and the exhaust channel 28.

Each of the sealing devices 30 and 30*a* which are provided on the downstream end of the exhaust casing wall 10 and the upstream end of the exhaust chamber support 11 has substantially the same configuration as each other. Therefore, hereinafter, the scaling device 30 which is provided on the downstream end of the exhaust casing wall 10 will be described. The description of the sealing device 30*a* which is provided on the upstream end of the exhaust chamber support 11 is omitted.

Figure 4:
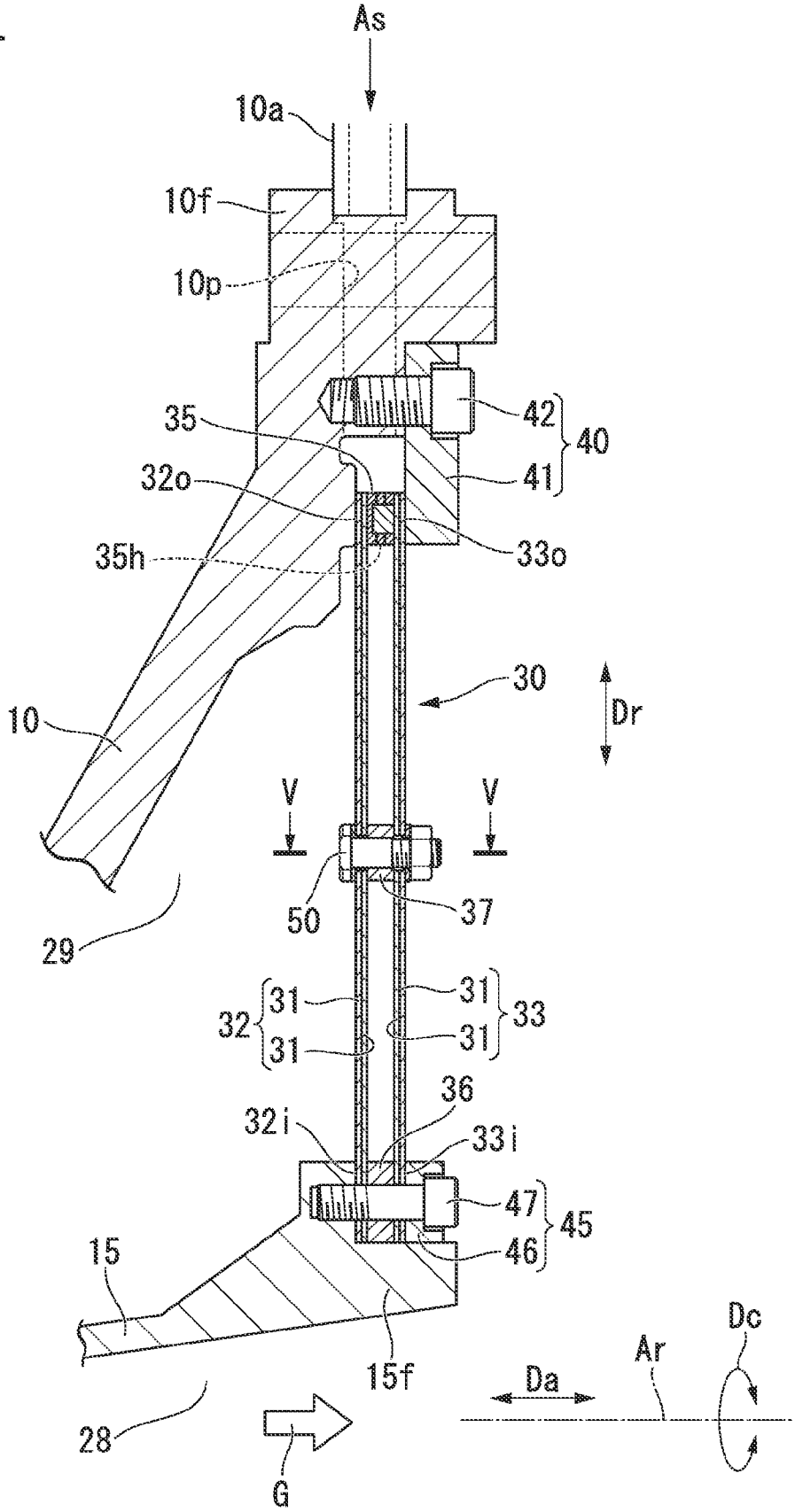
FIG. 4 is a cross-sectional view of the sealing device in the embodiment of the present invention.

As shown in FIG. 4, the sealing device 30 includes a first seal plate group 32 and a second seal plate group 33, and spaces 35, 36, and 37.

The first seal plate group 32 and the second seal plate group 33 include two seal plates which extend from the downstream end of the tubular external diffuser 15 to the outer side in the radial direction, reach the downstream end of the exhaust casing wall 10, and are laminated so as to contact each other on the surfaces which face the axial direction Da respectively. The spacers 35, 36, and 37 maintain the first seal plate group 32 and the second seal plate group 33 with intervals in the axial direction Da. In addition, the sealing device 30 includes an outside mounting tool 40 which mounts an outside end 32*o* in the radial direction of the first seal plate group 32 and an outside end 33*o* in the radial direction of the second seal plate group 33 to the exhaust casing wall 10, and an inside mounting tool 45 which mounts an inside end 32*i* in the radial direction of one seal plate group 32 and an inside end 33*i* in the radial direction of the other seal plate group 33 to the external diffuser 15.

In the first seal plate group 32 and the second seal plate group 33, the first seal plate group 32 configures a seal plate group which contacts air in the outside space 29 between the exhaust casing wall 10 and the external diffuser 15. The second seal plate group 33 configures a seal plate group which contacts the combustion gas G which flows through the exhaust channel 28. Hereinafter, the first seal plate group 32 is referred to as an air side seal plate group and the second seal plate group 33 is referred to as a combustion gas side seal plate group.

The spacers 35, 36, and 37 include the outside spacer 35, the inside spacer 36, and an intermediate spacer. The outside spacer 35 maintains the interval between the outside end 33*o* in the radial direction of the combustion gas side seal plate group 33 and the outside end 32*o* in the radial direction of the air side seal plate group 32. The inside spacer 36 maintains the interval between the inside end 33*i* in the radial direction of the combustion gas side plate group 33 and the inside end 32*i* in the radial direction of the air side seal plate group 32. The intermediate spacer maintains the interval of the combustion gas side seal plate group 33 and the air side seal plate group 32 between the outside spear 35 and the inside spacer 36.

A flange 15*f* is formed on the downstream end of the external diffuser 15. The inside mounting tool 45 includes a pressing plate 46 and a bolt 47. The pressing plate 46 contacts the inside end 33*i* in the radial direction of the combustion gas side seal plate group 33. Moreover, the pressing plate 46 of the inside mounting tool 45 sandwiches the combustion gas side seal plate group 33, the inside mounting tool 36, and the air side seal plate group 32 between the flange 15*f* and the pressing plate in the axial direction Da, and restricts the positions in the axial direction Da of the combustion gas side seal plate group 33, the inside spacer 36, and the air side seal plate group 32. The bolt 47 of the inside mounting tool 45 penetrates the combustion gas side plate group 33, the inside spacer 36, and the air side seal plate group 32 in the axial direction Da and restricts the positions in the radial direction Dr of the combustion gas side seal plate group 33, the inside spacer 36, and the air side seal plate group 32.

A flange 10*f* is formed on the downstream end of the exhaust casing wall 10. The outside mounting tool 40 includes a pressing plate 41 and a bolt 42. The pressing plate 41 contacts the outside end 33*o* in the radial direction of the combustion gas side seal plate group 33. The pressing plate 41 of the outside mounting tool 40 sandwiches the combustion gas side seal plate group 33, the outside spacer 35, and the air side seal plate group 32 between the flange 10*f* and the pressing plate in the axial direction Da, and restricts the positions in the axial direction Da of the combustion gas side seal plate group 33, the outside spacer 35, and the air side seal plate group 32. The bolt 42 of the outside mounting tool 40 is different from the bolt 47 of the inside mounting tool 45 and does not penetrate the combustion gas side seal plate group 33, the outside spacer 35, and the air side seal plate group 32. Thereby, the outside mounting tool 40 permits the relative movement in the radial direction Dr of the outside end 33*o* in the radial direction of the combustion gas side seal plate group 33, the outside spacer 35, and the outside end 32*o* in the radial direction of the air side seal plate group 32.

As shown in FIGS. 3 and 4, a seal air pipe 10*a* is connected to the outer side in the radial direction of the flange 10*f* of the exhaust casing wall 10. A seal air channel 10*p* which communicates with the channel in the seal air pipe 10*a* is formed in the flange 10*f*. The seal air channel 10*p* is opened to a position which faces the outside spacer 35 of the sealing device 30. A seal air hole 35*h* which penetrates from the outer side in the radial direction to the inner side in the radial direction is formed in the outside spacer 35. Thereby, in the present embodiment, if seal air As is supplied to the seal air pipe 10*a*, the seal air As is supplied to the space between the combustion gas side seal air plate group 33 and the air side seal plate group 32 via the seal air channel 10*p* of the flange 10*f* and the seal air hole 35*h* of the outside spacer 35.

Figure 5:
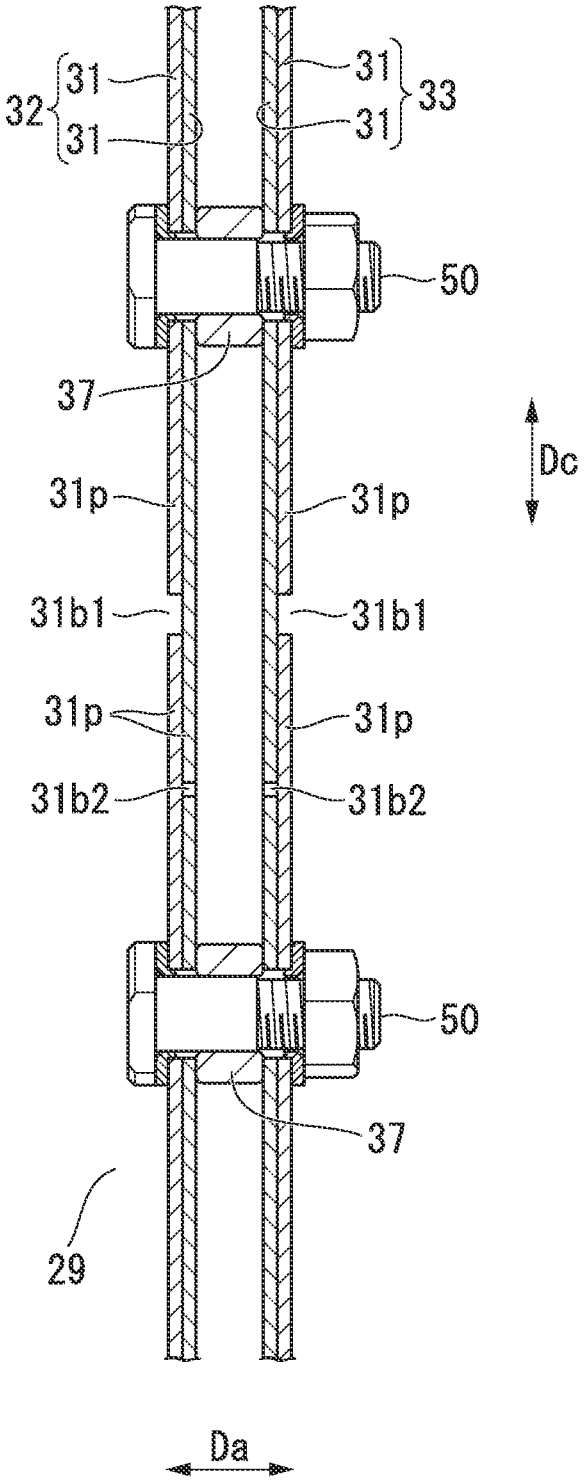
FIG. 5 is a cross-sectional view taken along a line V-V in FIG. 4.

As shown in FIG. 5, two seal plates 31 which configure the combustion gas side seal plate group 33 and two seal plate 31 which configure the air side seal plate group 32 are divided in the circumferential direction for the convenience of assembling. The seal plate 31 is configured by a plurality of divided pieces 31*p* which are arranged in the circumferential direction Dc. The position of a parting line 31*b*1 in the seal plate 31 of two seal plates 31 which configure the combustion gas side seal plate circumferential direction Dc in the plurality of divided pieces 31*p* which configure one seal plate 31 of two seal plates 31 which configure the combustion gas side seal plate group 33, and a position of a parting line 31*b*2 in the circumferential direction Dc in the divided pieces 31*p* which configure the other seal plate 31 which contacts the one seal plate 31 on the surface facing the axial direction Da are different from each other in the circumferential direction Dc. The position of a parting line 31*b*1 the circumferential direction Dc in the plurality of divided pieces 31*p* which configure one seal plate 31 of two seal plates 31 which configure the air side seal plate group 32, and a position of a parting line 31*b*2 in the circumferential direction Dc in the divided pieces 31*p* which configure the other seal plate 31 which contacts the one seal plate 31 on the surface facing the axial direction Da are different from each other in the circumferential direction Dc. Each seal plate 31 has thickness of the millimeter order so that each seal plate 31 is easily deformed in the thickness direction, in other words, in the axial direction Da.

Figure 6:
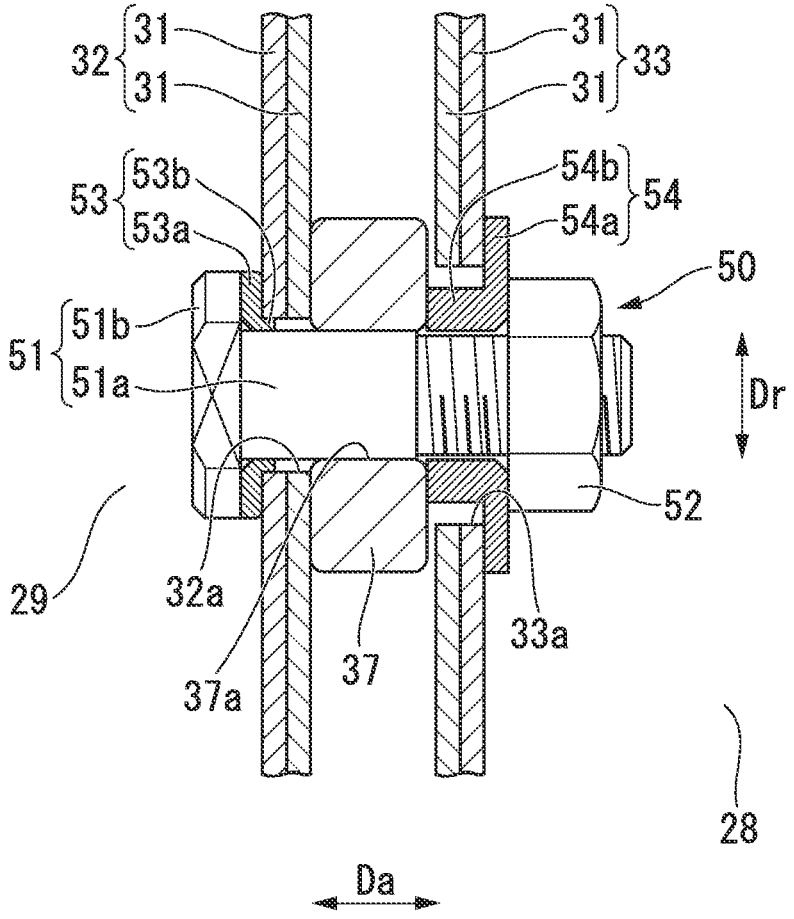
FIG. 6 is a cross-sectional view around an intermediate spacer in the embodiment according to the present invention.

As shown in FIG. 6, the sealing device 30 includes a connector 50 which make each of the combustion gas side seal plate group 33 and the air side seal plate group 32 come into close contact with the intermediate spacer 37 and connects to each other. The connector 50 includes a bolt 51, a nut 52 which is screwed to the shaft portion 51*a* of the bolt 51, a bolt side washer 53 which contacts a bolt head 51*b* of the bolt 51, and a nut side washer 54 which contacts the nut 52. The bolt side washer 53 and the nut side washer 54 include discoid flat seats 53*a* and 54*a* in which a seat surface and a through hole into which the shaft portion 51*a* of the bolt 51 is inserted are formed, and tubular flange portions 53*b* and 54*b* which are formed along the edges of the through holes of the flat seats 53*a* and 54*a* and into which the shaft portion 51*a* of the bolt 51 is inserted.

A bolt hole 37*a* which penetrates in the axial direction Da and into which the shaft portion 51*a* of the bolt 51 is inserted is formed in the intermediate spacer 37. A combustion gas side through hole 33*a* which penetrates in the axial direction Da and into which the flange portion (a penetrating portion of the connector 50) 54*b* of the nut side washer 54 is inserted is formed in the position of the combustion gas side seal plate group 33 corresponding to the intermediate spacer 37. Moreover, an air side through hole 32*a* which penetrates in the axial direction Da and into which the flange portion 53*b* of the bolt side washer 53 is inserted is formed In the position of the air side seal plate group 32 corresponding to the intermediate spacer 37.

When bringing each of the combustion gas side seal plate group 33 and the air side seal plate group 32 into close contact with the intermediate spacer 37 using the connector 50, first, the shaft portion 51*a* of the bolt 51 is inserted into the bolt side washer 53. Next, the shaft portion 51*a* of the bolt 51 is inserted into the air side through hole 32*a* of the air side seal plate group 32, the bolt hole 37*a* of the intermediate spacer 37, and the combustion gas side through hole 33*a* of the combustion gas side seal plate group 33 from the outside space 29 side between the exhaust casing wall 10 and the external diffuser 15. Next, the nut side washer 54 is mounted to the shaft portion 51*a* of the bolt 51 which protrudes to the exhaust channel 28 side from the combustion gas side seal plate group 33. By the mounting of the nut side washer 54, the cylindrical flange portion 54*b* of the nut side washer 54 is inserted into the combustion gas side through hole 33*a* of the combustion gas side seal plate group 33. In addition, the nut 52 is screwed to the shaft portion 51*a* of the bolt 51 which protrudes to the exhaust channel 28 side from the combustion gas side seal plate group 33.

Incidentally, the inner diameter of the air side through hole 32*a* is substantially the same as the outer diameter of the cylindrical flange portion 53*b* of the bolt side washer 53. Thereby, if the cylindrical flange portion 53*b* of the bolt side washer 53 is inserted into the air side through hole 32*a* of the air side seal plate group 32, the air side seal plate group 32 cannot move relative to the connector 50 (bolt side washer 53) in the radial direction Dr. On the other hand, the inner diameter of the combustion gas side through hole 33*a* is sufficiently larger than the outer diameter of the connector 50, that is, the outer diameter of the cylindrical flange portion 54*b* of the nut side washer 54 of the connector 50. Thereby, even when the cylindrical flange portion 54*b* of the nut side washer 54 is inserted into the combustion gas side through hole 33*a* of the combustion gas side seal plate group 33, the combustion gas side seal plate group 33 can move relative to the connector 50 in the radial direction.

Moreover, in FIG. 6, two seal plates 31 of the air side seal plate group 32 are inserted to the interval between the downstream side end surface of the flat seat 53*a* of the bolt side washer 53 and the upstream side end surface of the opposite intermediate spacer 37. The length in the axial direction of the flange portion 53*b* of the bolt side washer 53 (the length in the axial direction from the downstream side end surface of the flat seat 53*a* to the top of the flange portion 53*b*) is smaller than the thickness in the axial direction of two seal plates 31 of the air side seal plate group 32. Accordingly, when the seal plates 31 is inserted into the interval which is configured by the intermediate spacer 37 and the bolt side washer 53 and the bolt 51 and the nut 52 of the connector 50 are tightened in the axial direction, the relative movement in the radial direction Dr of the seal plates 31 of the air side seal plate group 32 with respect to the connector 50 is restricted.

On the other hand, two seal plates 31 of the combustion gas side seal plate group 33 are inserted into the interval between the upstream side end surface of the flat seat 54*a* of the nut side washer 54 and the downstream side end surface of the opposite intermediate spacer 37. The length in the axial direction of the flange portion 54*b* of the nut side washer 54 (the length in the axial direction from the upstream side end surface of the flat seat 54*a* to the top of the flange portion 54*b*) is larger than the thickness in the axial direction of two plates 31 of the combustion gas side seal plate group 33. Accordingly, even when the bolt 51 and the nut 52 of the connector 50 are tightened, the top of the flange portion 54*b* of the nut side washer 54 contacts the downstream side end surface of the intermediate spacer 37, and further tightening of the nut 52 is difficult. That is, even when the bolt 51 and the nut 52 are tightened after the seal plates 31 are inserted into the interval in the axial direction which is formed between the downstream side end surface of the intermediate spacer 37 and the upstream side end surface of the flat seat 54*a*of the nut side washer 54, a slight interval is generated between the seal plate 31 of the combustion gas side seal plate group 33 and the upstream side end surface of the flat seat 54*a* of the nut side washer 54 or between the seal plate 31 and the downstream side end surface, of the intermediate spacer 37. Therefore, the relative movement in the radial direction Dr of the seal plates 31 of the combustion gas side seal plate group 33 with respect to the connector 50 is not restricted.

That is, as described above, the relative movement in the radial direction Dr of the air side seal plate group 32 with respect to the connector 50 cannot be performed. On the other hand, the seal plates 31 of the combustion gas side seal plate group 33 include the combustion gas side through hole 33*a* having the inner diameter which is sufficiently greater than the outer diameter of the connector 50, and the thickness in the axial direction of the seal plate is smaller than the interval in the axial direction which is formed of the intermediate spacer 37 and the nut side washer 54. Thereby, the relative movement in the radial direction Dr of the combustion gas side seal plate group 33 with respect to the connector 50 can be performed.

In addition, if the seal plates 31 of the combustion gas side seal plate group 33 include the combustion gas side through hole 33*a* having the inner diameter which is larger than the outer diameter of the connector 50, the thickness in the axial direction of the seal plate 31 may be the same as the interval in the axial direction which is formed of the intermediate spacer 37 and the nut side washer 54. That is, the interval may not be formed between the seal plate 31 of the combustion gas side seal plate group 33 and the upstream side end surface of the flat seat 54*a* of the nut side washer 54 or between the seal plate 31 and the downstream side end surface of the intermediate spacer 37.

Next, the operation and effects of the above-described sealing device 30 will be described.

In the present embodiment, since the exhaust channel 28 side, and the outside space 29 of the exhaust casing wall 10 and the external diffuser 15 are partitioned by the air side seal plate group 32 and the combustion gas side seal plate group 33, sealing can be performed between the outside space 2 and the exhaust channel 28 side.

In the present embodiment, as described with reference to FIG. 5, each of two seal plates 31 which configure each of the seal plate groups 32 and 33 is divided in the circumferential direction Dc for the convenience of assembling, and is configures by the plurality of divided pieces 31*p*. Thereby, in one seal plate 31, air or combustion gas G is leaked from the parting line 31*b*1 of the divided pieces 31*p* which are aligned in the circumferential direction Dc. However, in the present embodiment, the position of the parting line 31*b*1 in the circumferential direction Dc in the plurality of divided pieces 31*p* which configure one seal plate 31 of two seal plates 31 which configure the seal plate groups 32 or 33, and the position of the parting line 31*b*2 in the circumferential direction Dc in the plurality of divided pieces 31*p* which configure the other seal plate 31 which contacts the one seal plate 31 on the surface facing the axial direction Da are different from each other in the circumferential direction Dc. Thereby, even when air or the combustion gas G is leaked from the parting line 31*b*1 of the circumferential direction Dc is the plurality of divided pieces 31*p* which configure one seal plate 31, the air or the combustion gas G is sealed by the other seal plate 31 which contacts the one seal plate 31 on the surface facing the axial direction Da, and the leakage can be prevented.

In the present embodiment, the seal air As is supplied between the air side seal plate group 32 and the combustion gas side seal plate group 33 from the outside, and the supplied seal air As pressurizes between these. It is possible to prevent air in the outside space 29 or the combustion gas G of the exhaust channel 28 side from flowing into between the air side seal plate group 32 and the combustion gas side seal plate group 33.

Thereby, the sealing device 30 of the present embodiment can increase scalability between the outside space 29 between the exhaust casing wall 10 and the external diffuser 15, and the exhaust channel 28 side.

Incidentally, during operation of the gas turbine, the external diffuser 15 contacts high temperature combustion gas G and the exhaust casing wall 10 contacts the atmosphere. Thereby, a thermal expansion difference due to a temperature difference is generated between the external diffuser 15 and the exhaust casing wall 10 during operation of the gas turbine. The thermal expansion difference between the external diffuser 15 and the exhaust casing wall 10 appears as the relative displacement in the axial direction Da and the radial direction Dr of the flange 15*f* of the external diffuser 15 with respect to the flange 10*f* of the exhaust casing wall 10.

With respect to the relative displacement in the axial direction Da of the flange 15*f* of the external diffuser 15 to the flange 10*f* of the exhaust casing wall 10, in the sealing device 30 of the present embodiment, since each seal plate 31 which is easily deformed in the axial direction Da is deformed in the axial direction. Da, the relative displacement of the flanges 10*f* and 15*f* in the axial direction Da is permitted.

With respect to the relative displacement in the radial direction Dr of the flange 15*f* of the external diffuser 15 to the flange 10*f* of the exhaust casing wall 10, in the sealing device 30 of the present embodiment, since the outside ends 32*o* and 33*o* in the radial direction of each of the seal plate groups 32 and 33 and the outside spacer 35 move relative to the flange 10*f* of the exhaust casing wall 10 in the radial direction Dr, the relative displacement of the flanges 10*f* and 15*f* in the radial direction Dr is permitted. However, in the sealing device 30 of the present embodiment, since each seal plate 31 is easily deformed in the axial direction Da, if the relative displacement of the flanges 10*f* and 15*f* in the radial direction Da, is generated, each seal plate 31 is deformed in the axial direction Da, and the relative displacement of the flanges 10*f* and 15*f* in the radial direction Dr is permitted to some extent.

Figure 7:
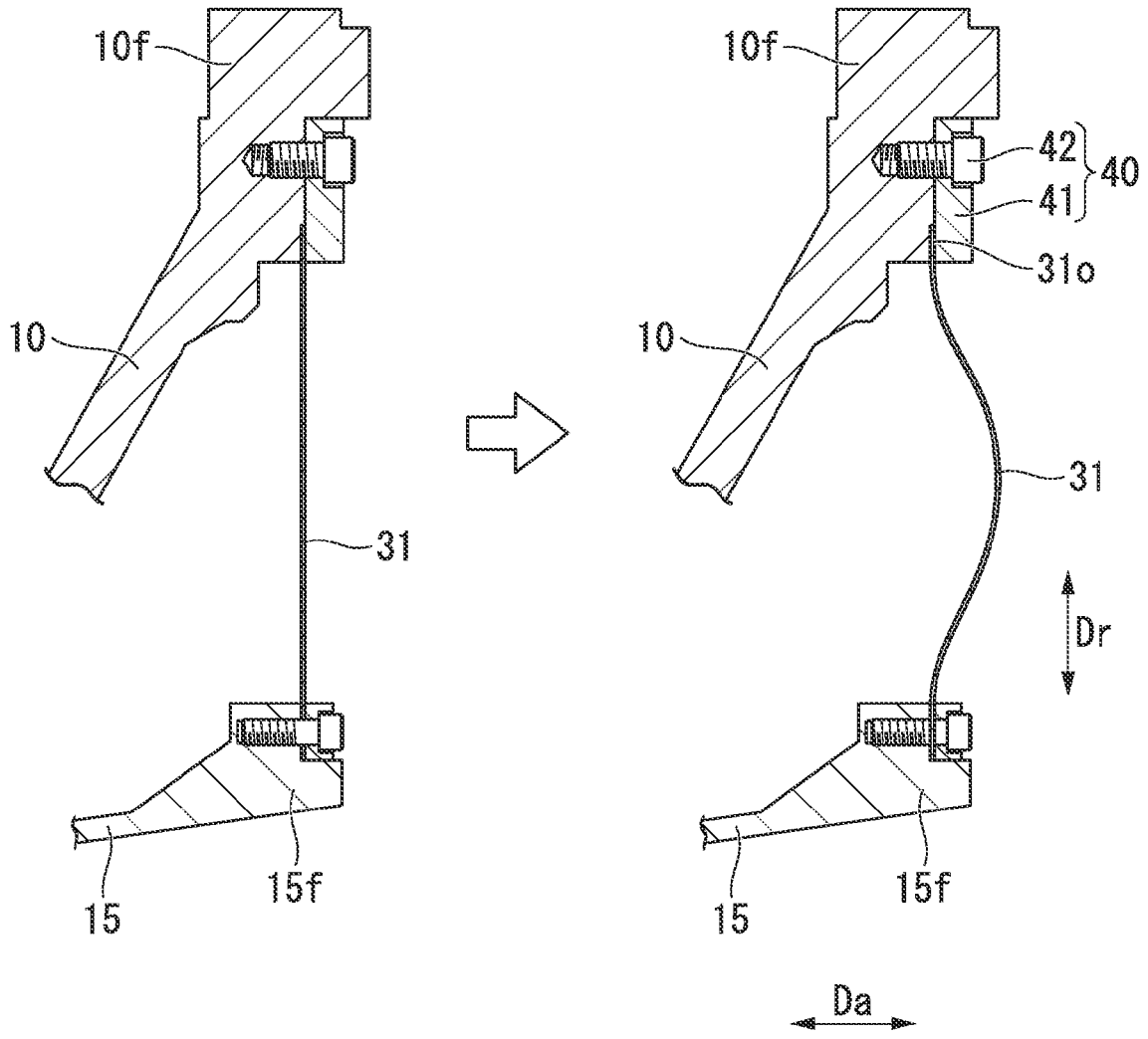
FIG. 7 is an explanatory view showing a state when the sealing is carried out by one seal plate.

As shown in FIG. 7, a case where the outside space 29 between the external diffuser 15 and the exhaust casing wall 10, and the exhaust channel 28 side are sealed by one seal plate 31 is considered.

When the flange 15*f* of the external diffuser 15 is displaced toward a side of approaching the flange 10*f* of the exhaust casing wall 10 in the radial direction Dr, one seal plate 31 which is easily deformed in the axial direction Da is deformed in the axial direction Da, and it is considered that the outside end 31*o* in the radial direction does not move to the outer side in the radial direction. When the displacement amount of the flange 15*f* of the external diffuser 15 toward the side of approaching the flange 10*f* of the exhaust casing wall 10 in the radial direction Dr is large, if the seal plate 31 is to permit the relative displacement of the flanges 10*f* and 15*f* by only the displacement in the axial direction Da, the displacement amount of the seal plate 31 in the axial direction Da is increased, and there is a concern that the seal plate 31 may be buckled.

In the present embodiment, since the interval in the axial direction Da between the air side seal group 32 which is configured of the seal plates 31 which are easily displaced in the axial direction Da and the combustion gas side seal plate group 33 which is similarly configured of the seal plates 31 which are easily displaced in the axial direction Da is secured by the spacers 35, 36, and 37, buckling strength in the radial direction Dr is improved in the member which is a combination of the air side seal plate group 32, the combustion gas side seal plate group 33, and each of the spacers 35, 36, and 37. In the present embodiment, since the intermediate spacer 37 is provided and the supporting point span of the air side seal plate group 32 and the combustion gas side seal plate group 33 is decreased in the radial direction Dr, buckling strength in the radial direction Dr is further improved in the member which is a combination of the air side seal plate group 32, the combustion gas side seal plate group 33, and each of the spacers 35, 36, and 37. As a result, in the present embodiment, when the flange 15*f* of the external diffuser 15 is displaced toward a side of approaching the flange 10*f* of the exhaust casing wall 10 in the radial direction Dr, the deformation in the axial direction Da of each seal plate 31 is suppressed without buckling, and the outside ends 32*o* and 33*o* in the radial direction of each of the seal plate groups 32 and 33 move to the outer side in the radial direction.

Incidentally, during the operation of the gas turbine, the combustion gas side seal plate group 33 contacts high temperature combustion gas G while the air side seal plate group 32 contacts air. Thereby, the amount of thermal expansion in the radial direction Dr of the combustion gas side seal plate group 33 becomes larger than that of the air side seal plate group 32. Accordingly, during the operation of the gas turbine, the distance from the inside end 33*i* in the radial direction of the combustion gas side seal plate group 33 to the combustion gas side through hole 33*a* which penetrates the combustion gas side seal plate group 33 becomes larger than the distance from the inside end 32*i* in the radial direction of the air side seal plate group 32 to the air side through hole 32*a* which penetrates the air side seal plate group 32.

Figure 8A:
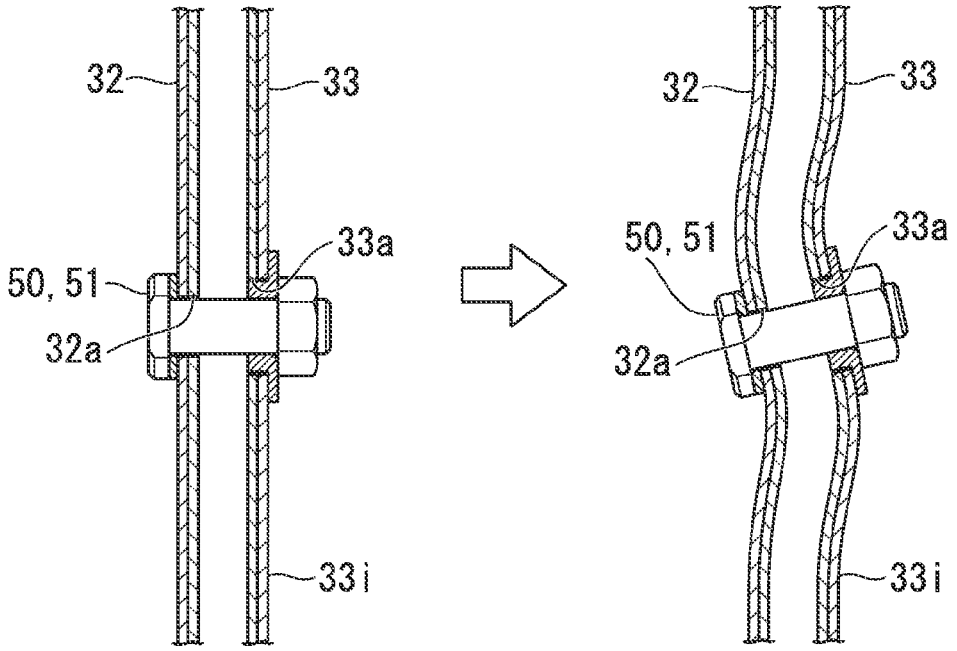
FIG. 8A is an explanatory view showing deformation of a seal plate group when a first seal plate group and a second seal plate group cannot move relative to a connector in the radial direction.
Figure 8B:
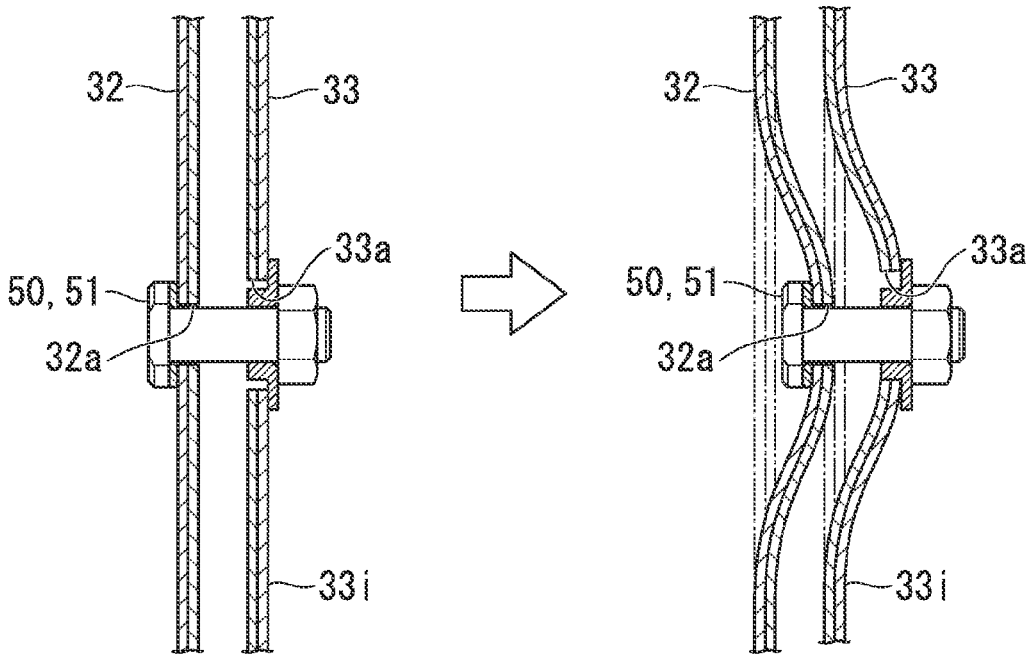
FIG. 8B is an explanatory view showing deformation of the seal plate group when the second seal plate group can relatively move in the radial direction with respect to the connector.

When both the air side seal plate group 32 and the combustion gas side seal plate group 33 cannot move relative to the connector 50 in the radial direction Dr, as described above, the distance from the inside end 33*i* in the radial direction of the combustion gas side seal plate group 33 to the combustion gas side through hole 33*a* which penetrates the combustion gas side seal plate group 33 is increased. Thereby, as shown in FIG. 8(*a*), the connector 50 is inclined in a direction to the outer side in the radial direction toward the downstream side. In this way, if the connector 50 is inclined, the combustion gas side seal plate group 33 and the air side seal plate group 32 are locally deformed in the vicinity of the connector 50. Moreover, the seal plate groups contact the outer edge of each of the washers 53 and 54 of the connector 50, and there is a concern that the combustion gas side seal plate 33 and the air side seal plate group 32 may be damaged.

As described with reference to FIG. 6, in the present embodiment, the inner diameter of the combustion gas side through hole 33*a* of the combustion gas side seal plate group 33 is sufficiently larger than the outer diameter of the flange portion 54*b* of the nut side washer 54 of the connector 50, and thus, the combustion gas side seal plate group 33 can move relative to the connector 50 in the radial direction Dr. Thereby, in the present embodiment, during the operation of the gas turbine, even when the distance from the inside end 33*i* in the radial direction of the combustion gas side seal plate group 33 to the combustion gas side through hole 33*a* which penetrates the combustion gas side seal plate group 33 is increased, since the connector 50 moves relative to the combustion gas side through hole 33*a*, as shown in FIG. 8(*b*), the connector 50 is not inclined. Accordingly, in the present embodiment, damages of the combustion gas side seal plate group 33 and the air side seal plate group 32 due to the inclination of the connector 50 can be avoided.

In the present embodiment, the inner diameter of the combustion gas side through hole 33*a* of the combustion gas side seal plate group 33 is sufficiently larger than the outer diameter of the flange portion 54*b* of the air side washer 54 of the connector 50. Conversely, even when the inner diameter of the air side through hole 32*a* of the air side seal plate group 32 is sufficiently larger than the outer diameter of the penetrating portion of the connector 50, the inclination of the connector 50 can be suppressed.

It is considered that the plurality of seal plates 31 which contact each gas is vibrated due to the combustion gas G which exists in the inner side In the radial direction of the external diffuser 15 and air which exists in the outer side in the radial direction of the external diffuser 15. In the present embodiment, the combustion gas side seal plate group 33 is configured of two seal plates 31, and the air side seal plate group 32 is also configured by two seal plates 31. Thereby, even when the seal plate 31 which contacts the combustion gas G in two seal plates 31 of the combustion gas side seal plate group 33 receives vibration energy from the combustion gas G, due to friction with the other seal plate 31 which contacts the seal plate 31 on the surface facing the axial direction Da wherein the seal plate 31 contacts the combustion gas G, the vibration energy is absorbed, and the vibration of two seal plates 31 can be decreased. Similarly, even when the seal plate 31 which contacts air in two seal plates 31 of the air side seal plate group 32 receives vibration energy from the air, due to friction with the other seal plate 31 which contacts the seal plate 31 on the surface facing the axial direction Da wherein the seal plate 31 contacts the air, the vibration energy is absorbed, and the vibration of two seal plates 31 can be decreased. In the present embodiment, due to the fact that the intermediate spacer 37 is provided, since the supporting point spans of the air side seal plate group 32 and the combustion gas side seal plate group 33 in the radial direction Dr are decreased, vibration amplitudes of each of the seal plate groups 32 and 33 can be decreased.

In the present embodiment, the vibration of each of the seal plate groups 32 and 33 can be decreased, and damage of the seal plates 31 due to the vibration can be suppressed. That is, in the present embodiment, since each of the seal plate groups 32 and 33 is configured of the plurality of seal plates 31, leakage of gas from the parting lines 31*b*1 of the plurality of divided pieces 31*p* which configure the seal plate 31 is prevented, and the damage of the seal plates 31 due to vibration is suppressed.

As described above, the preferred embodiment of the present invention is described. However, the present invention is not limited to the embodiment. Addition, omission, substitution, and other modifications of the configuration are possible within the scope which does not depart from the gist of the present invention. The present invention is not limited by the above-described explanation, and is limited only by the scope of the attached claims.

In the present embodiment, each of the seal plate groups 32 and 33 is configured of two seal plates 31. However, each seal plate group may be configured of three or mom seal plates 31.

In the present embodiment, the sealing device 30 which is provided at the downstream end of the exhaust casing wall 10 is described as the representative. However, since the sealing device 30*a* which is provided at the upstream end of the exhaust chamber support 11 also has the configurations substantially similar to the sealing device 30 which is provided at the downstream end of the exhaust casing wall 10, the operation and effects similar to the sealing device 30 of the present embodiment can be obtained by the sealing device 30*a*.

Also when another sealing device is provided at further downstream side than the sealing device 30*a* which is provided at the upstream end of the exhaust chamber support 11, it is preferable that the another sealing device be the sealing device which has the configurations similar to the sealing device 30 of the present embodiment.

INDUSTRIAL APPLICABILITY

The present invention relates to a sealing device which seals an end of a diffuser of a gas turbine, and a gas turbine having the same. In the present invention, since an outside space and an exhaust channel side are partitioned by a first and second seal plate groups, sealing can be performed between the outside space and the exhaust channel side. In the present invention, since the vibration of each seal plate group can be decreased, damage to the seal plate due to vibration can be suppressed.

DESCRIPTION OF SYMBOLS

1: compressor, 2: combustor, 3: turbine, 4: casing, 5: turbine rotor, 8: blade, 10: exhaust casing wall (outside member), 10*p*: seal air channel, 11: exhaust chamber support, 12: exhaust chamber, 15, 17: external diffuser, 16, 18, 19: internal diffuser 27, 28: outside space, 29: exhaust channel 30, 30*a*: sealing device, 31: seal plate, 31*p*: divided piece, 32: air side seal plate group (first seal plate group), 33: combustion gas side seal group (second seal plate group), 33*a*: combustion gas side through hole, 35: outside spacer, 36: inside spacer, 37: intermediate spacer, 40: outside mounting tool, 45: inside mounting tool, 50: connector 54: nut side washer, flange portion: 54*b*.

The invention claimed is:

1. A sealing device which seals between an outside space between an outer side in the radial direction of an external diffuser which has a tubular shape and forms an exhaust channel through which combustion gas rotating a rotor of a gas turbine passes in the inner side in the radial direction and an outside member which is disposed outside the external diffuser with an interval between them in the radial direction, and the exhaust channel by an end of the external diffuser, the sealing device comprising:

a first seal plate group and a second seal plate group which include a plurality of seal plates, wherein the plurality of seal plates, which extend to the outer side in the radial direction from the end of the tubular external diffuser and reach the outside member, are laminated in contact with each other; and a spacer is sandwiched between the first seal plate group and the second seal plate group, and maintains an interval between the first seal plate group and the second seal plate group in an axial direction in which a rotational axis of the rotor extends, wherein the spacer includes an outside spacer which maintains an interval between an outer side portion in the radial direction of the first seal plate group and an outer side portion in the radial direction of the second seal plate group, and an inside spacer which maintains an interval between an inner side portion in the radial direction of the first seal plate group and an inner side portion in the radial direction of the second seal plate group, and wherein a seal air hole which penetrates from the outer side in the radial direction toward the inner side in the radial direction is formed in the outside spacer.

2. The sealing device according to claim 1, wherein the plurality of seal plates of the first seal plate group or the second seal plate group are configured so as to have a plurality of divided pieces which are aligned in a circumferential direction around the rotor, and one divided piece forms a portion of one of the seal plates in the circumferential direction, and a position of a parting line in the circumferential direction in the plurality of divided pieces which configure the first seal plate group or the second seal plate group, and a position of a parting line in the circumferential direction in other divided pieces which contact the divided pieces on a surface facing the axial direction wherein the divided pieces configures the first seal plate group or the second seal plate group are different from each other in the circumferential direction.

3. The sealing device according to claim 1, further comprising:

an intermediate spacer which maintains an interval between the first seal plate group and the second seal plate group between the outside spacer and the inside spacer.

4. The sealing device according to claim 3, further comprising:

a connector which penetrates the first seal plate group, the intermediate spacer, and the second seal plate group and brings the first seal plate group and the second seal plate group into close contact with the intermediate spacer, wherein a combustion gas side through hole, which is formed in the second seal plate group and which the connector penetrates, is formed so as to be larger than the outer diameter of the connector so that the second seal plate group moves relative to the connector in the radial direction.

5. The sealing device according to claim 4, wherein a thickness in the axial direction of the second seal plate group is formed so as to be smaller than an interval in the axial direction which is formed between the intermediate spacer and a nut side washer of the connector.

6. The sealing device according to claim 1, further comprising:

an outside mounting tool which sandwiches the outer side portion in the radial direction of the first seal plate group, the outside spacer, and the outer side portion in the radial direction of the second seal plate group between the outside member and the outside mounting tool in the axial direction and mounts the outer side portions of the first and second seal plate groups and the outside spacer to the outside member; and an inside mounting tool which sandwiches the inner side portion in the radial direction of the first seal plate group, the inside spacer, and the inner side portion in the radial direction of the second seal plate group between the external diffuser and the inside mounting tool in the axial direction and mounts the inner side portions of the first and second seal plate groups and the inside spacer to the external diffuser, wherein any one mounting tool of the inside mounting tool and the outside mounting tool mounts the first seal plate group and the second seal plate group so as to be able to move relative to the external diffuser or the outside member to be mounted in the radial direction.

7. A gas turbine comprising:

the sealing device according to claim 1;

a compressor compressing air; and a combustor which combusts fuel in the air compressed by the compressor and generates the combustion gas.

8. The gas turbine according to claim 7, further comprising:

a seal air channel which is formed in the outside member and supplies seal air between the first seal plate group and the second seal plate group.

* * * * *